US005397258A

United States Patent [19]

Switlik et al.

[11] Patent Number: 5,397,258

[45] Date of Patent: Mar. 14, 1995

[54] POLYGONALLY SHAPED INFLATABLE RAFT APPARATUS

[75] Inventors: Stanley Switlik, Pennington, N.J.; Christopher M. Frelick, Newtown, Pa.

[73] Assignee: Switlik Parachute Company, Inc., Trenton, N.J.

[21] Appl. No.: 175,452

[22] Filed: Dec. 30, 1993

[51] Int. Cl.[6] ..... B63B 35/58

[52] U.S. Cl. ..... 441/40

[58] Field of Search ..... 441/35, 38, 40–42; 114/343, 345, 357, 354

[56] References Cited

U.S. PATENT DOCUMENTS

| | | | |
|---|---|---|---|
| 838,691 | 12/1906 | Dalton . | |
| 1,884,705 | 10/1932 | Huffman . | |
| 2,584,884 | 2/1952 | Kirby . | |
| 2,689,812 | 9/1954 | Mollica et al. . | |
| 2,752,616 | 7/1956 | Coates et al. . | |
| 2,854,049 | 9/1958 | Wyllie . | |
| 2,876,467 | 3/1959 | Lund . | |
| 2,933,739 | 4/1960 | Miller et al. . | |
| 3,056,980 | 10/1962 | Holladay . | |
| 3,072,930 | 1/1963 | Fraebel . | |
| 3,130,406 | 4/1964 | Jones-Hinton et al. . | |
| 3,336,613 | 8/1967 | Wales . | |
| 3,428,978 | 2/1969 | Johnson . | |
| 3,653,084 | 4/1972 | Hartman . | |
| 3,685,066 | 8/1972 | Edwards . | |
| 3,768,761 | 10/1973 | Cramer . | |
| 3,843,983 | 10/1974 | Tangen . | |
| 3,870,006 | 3/1975 | Hashimoto . | |
| 4,135,325 | 1/1979 | Lehman . | |
| 4,159,551 | 7/1979 | Iwai | 114/345 |
| 4,216,559 | 8/1980 | Switlik, Jr. . | |
| 4,517,914 | 5/1985 | Geracitano . | |
| 4,545,319 | 10/1985 | Ferronniere et al. . | |
| 4,628,854 | 12/1986 | Harding | 114/345 |
| 4,640,217 | 2/1987 | Ferronniere | 441/40 |
| 4,678,443 | 7/1987 | Edwards et al. . | |
| 4,723,502 | 2/1988 | Sayama | 441/40 |
| 4,744,326 | 5/1988 | Harding . | |
| 4,750,446 | 6/1988 | Sussman . | |
| 4,750,894 | 6/1988 | Nealey . | |
| 5,136,962 | 8/1992 | Palmer, Jr. et al. . | |

*Primary Examiner*—Stephen P. Avila
*Attorney, Agent, or Firm*—Sperry, Zoda & Kane

[57] ABSTRACT

A inflatable raft having multiple inflation members formed into a polygonal shape wherein the panel segments include inner and outer flaps which form an overlap or closing seam wherein the outer flap includes an extended outer flap segment to form a modular member for interconnection with respect to a raft floor or cover apparatus. The extended outer flap segment also facilitates heat sealing for securement of a cover, canopy or floor with respect to an inflatable polygonal construction. The configuration of the polygonal inflatable raft with the extended outer flap segment can be used singly to form a flotation raft or can be used doubly to form an invertible inflation raft apparatus or a canopy covered inflatable raft apparatus.

20 Claims, 3 Drawing Sheets

POLYGONALLY SHAPED INFLATABLE RAFT APPARATUS

BACKGROUND OF THE INVENTION

1. Field of the Invention

The present invention pertains generally to the field of raft designs and, in particular, to inflatable raft configurations having multiple straight outer panels sections defining inflatable chambers therein for establishing raft buoyancy. The polygonal shape for an inflatable raft is well known as being reliable and durable during harsh usage conditions wherein a plurality of linear inflatable sections are formed into an overall polygonal shape.

The present invention further pertains to those polygonal shaped inflatable rafts which are vertically invertible and also those inflatable rafts which can include covers or canopies extending thereover.

2. Description of the Prior Art

Many prior art designs have been patented for inflatable rafts utilizing multiple flotation chambers defined in a plurality of outer panels such as U.S. Pat. No. 838,691 patented Dec. 18, 1906 to J. W. Dalton and assigned to Dalton Life-Saving Appliance Co. on a "Breeches Buoy"; and U.S. Pat. No. 1,884,705 patented Oct. 25, 1932 to W. E. Huffman on a "Pneumatic Boat"; and U.S. Pat. No. 2,584,884 patented Feb. 5, 1952 to H. L. Kirby and assigned to Helen V. Peez on a "Life Raft"; and U.S. Pat. No. 2,689,812 patented Sep. 21, 1954 to R. Mollica et al and assigned to United States Rubber Company on a "Method Of Making Inflatable Fabric Lined Rubber Articles"; and U.S. Pat. No. 2,752,616 patented Jul. 3, 1956 to J. Coates et al on "Inflatable Life Rafts"; and U.S. Pat. No. 2,854,049 patented Sep. 30, 1958 to S. Wyllie and assigned to Elliot Equipment Limited on "Collapsible Storage Tanks"; and U.S. Pat. No. 2,876,467 patented Mar. 10, 1959 to A Lund on a "Collapsible Raft"; and U.S. Pat. No. 2,933,739 patented Apr. 26, 1960 to R. Miller et al and assigned to The Goodyear Tire & Rubber Company on a "Life Raft"; and U.S. Pat. No. 3,056,980 patented Oct. 9, 1962 to F. Holladay on "Plastic Sheeting Articles And Manufacture"; and U.S. Pat. No. 3,072,930 patented Jan. 15, 1963 to R. Fraebel and assigned to The Garrett Corporation on a "Spaced Tube Inflatable Life Raft"; and U.S. Pat. No. 3,130,406 patented Apr. 21, 1964 to J. Jones-Hinton et al and assigned to Dunlop Rubber Company Limited on "Radar Reflectors And Life Rafts Incorporating Same"; and U.S. Pat. No. 3,336,613 patented Aug. 22, 1967 to F. Wales on a "Life Preserver"; and U.S. Pat. No. 3,428,978 patented Feb. 25, 1969 to C. Johnson on a "Shark Screen"; and U.S. Pat. No. 3,653,084 patented Apr. 4, 1972 to M. Hartman on an "Inflatable Structure"; and U.S. Pat. No. 3,685,066 patented Aug. 22, 1972 to D. Edwards on a "Liferaft Inflation System"; and U.S. Pat. No. 3,768,761 patented Oct. 30, 1973 to R. Cramer and assigned to The Bendix Corporation on an "Inflatable Life Raft"; and U.S. Pat. No. 3,843,983 patented Oct. 29, 1974 to W. Tangen and assigned to Gewako S. A. on an "Arrangement Related To Inflatable Life Rafts"; and U.S. Pat. No. 3,870,006 patented Mar. 11, 1975 to M. Hashimoto on a "Stabilizing Device For Buoyant Body"; and U.S. Pat. No. 4,135,325 patented Jan. 23, 1979 to J. Lehman and assigned to Warner-Lehman Corporation on an "Inflatable Flying Saucer Toy"; and U.S. Pat. No. 4,517,914 patented May 21, 1985 to V. Geracitano on an "Inflatable Reversible Liferaft"; and U.S. Pat. No. 4,545,319 patented Oct. 8, 1985 to M. Ferronniere et al and assigned to Zodiac on "Pneumatic Boats Of The Inflatable-Deflatable Type"; and U.S. Pat. No. 4,678,443 patented Jul. 7, 1987 to D. Edwards et al and assigned to RFD Limited on an "Inflatable Liferaft"; and U.S. Pat. No. 4,744,326 patented May 17, 1988 to R. Harding and assigned to Avon Inflatables Limited on a "Self-Bailing Inflatable Boat"; and U.S. Pat. No. 4,740,446 patented Jun. 14, 1988 to R. Sussman on an "Inflatable Sailboat"; and U.S. Pat. No. 4,750,894 patented Jun. 14, 1988 to C. Nealey and assigned to Brt Plc on a "Liferaft"; and U.S. Pat. No. 5,136,962 patented Aug. 11, 1992 to J. Palmer, Jr. et al on "Aquatic Vessels".

SUMMARY OF THE INVENTION

The present invention provides an inflatable raft apparatus having a polygonally shaped inflatable construction formed of a plurality of individual tubular shaped panel members. These panel members are end joined with respect to one another to form this polygonal shape. Each panel member is formed with an outer flap along one of the straight outer ends and an inner flap along the other opposite straight outer end. These flaps are secured to each other to seal the inflatable panel. Each panel member also includes arcuate side edges such that when the inner flap and the outer flap are heat sealed to one another to form the closing seam the panel will present an outer edge which is easily end joined to adjacent similar panel constructions. This shape will be more fully discussed in the detailed description of the preferred embodiments.

With the inner flap and the outer flap secured with respect to one another in an overlap seam the main panel wall will assume a generally tubular shape to define an opening in each end which will connect with a similarly shaped opening of an adjacently positioned main panel wall within the polygonal inflatable construction. The present invention provides an extended outer flap segment extending away from the outer flap and being integral therewith to facilitate attachment of peripheral items thereto. The use of a single piece of integral material for forming the inner flap as well as the main panel wall extending therefrom and the outer flap as well as the extended outer flap segment extending away from the outer flap provides a unique overall construction not shown in the prior art. The use of the extended outer flap segment provides a means for easily securing of a cover or a floor or both with respect to a single raft configuration. The extended outer flap segment also provides a means for securing multiple polygonally shaped inflatable raft segments with respect to one another to form an invertible raft or a covered raft design.

Prior art inflatable raft designs do make use of an overlap seam used as the closing seam between an inner and outer flap of a main panel wall. With the present invention, however, the use of a single piece of material to form this entire structure as well as forming the extended outer flap segment provides a novel construction having unique aspects for assembly of such inflatable rafts.

The extended outer flap segment of the present invention can extend inwardly from the polygonal inflatable member to form a floor therewithin. In a similar manner, however, the extended outer flap segment of the present invention can extend outwardly if it is desired to attach a floor or other member outside of the polygonally shaped inflatable member rather than therewithin. Furthermore, the extended outer flap segment of the present invention can extend solely upwardly or upwardly and inwardly to facilitate positioning of the canopy or cover above an inflatable raft apparatus. Each of these designs will be more fully explained in the detailed description of the preferred embodiment.

It is an object of the present invention to provide a polygonally shaped inflatable raft apparatus having an extended outer flap segment integral therewith and extending therefrom wherein a raft floor can be easily secured to the extended outer flap segment.

It is an object of the present invention to provide a polygonally shaped inflatable raft apparatus having an extended outer flap segment integral therewith and extending therefrom wherein heat sealing can be used to attach the floor to the extended outer flap segment.

It is an object of the present invention to provide a polygonally shaped inflatable raft apparatus having an extended outer flap segment integral therewith and extending therefrom wherein heat sealing can be utilized to attach the outer flap to the inner flap to form a closing overlap seam which is fully sealed.

It is an object of the present invention to provide a polygonally shaped inflatable raft apparatus having an extended outer flap segment integral therewith and extending therefrom wherein the inflatable members can be formed into a regular polygon shape.

It is an object of the present invention to provide a polygonally shaped inflatable raft apparatus having an extended outer flap segment integral therewith and extending therefrom wherein the inflatable members can be formed into an irregular polygon shape having different length panels or an odd number thereof.

It is an object of the present invention to provide a polygonally shaped inflatable raft apparatus having an extended outer flap segment integral therewith and extending therefrom wherein the axes of the buoyancy chambers defined within the panel members are linear to form the straight outer dimensions of the polygon shape.

It is an object of the present invention to provide a polygonally shaped inflatable raft apparatus having an extended outer flap segment integral therewith and extending therefrom wherein internal taping can be utilized extending over the heat sealed closing seam between the outer flap and the inner flap to facilitate sealing of the closing seal therebetween.

It is an object of the present invention to provide a polygonally shaped inflatable raft apparatus having an extended outer flap segment integral therewith and extending therefrom wherein V-shaped tape means can be utilized secured to the outer flap and inner flap to facilitate heat sealing and affixing of the overlap seam therebetween.

It is an object of the present invention to provide a polygonally shaped inflatable raft apparatus having an extended outer flap segment integral therewith and extending therefrom wherein the number of adhesive interconnections utilized on an inflatable raft can be minimized in order to eliminate this secondary operation.

It is an object of the present invention to provide a polygonally shaped inflatable raft apparatus having an extended outer flap segment integral therewith and extending therefrom wherein the number of seams which may be heat sealed within a polygonally shaped inflatable apparatus can be maximized to minimize labor costs and manual assembly steps.

It is an object of the present invention to provide a polygonally shaped inflatable raft apparatus having an extended outer flap segment integral therewith and extending therefrom wherein the amount of adhesive utilized in the process of assembling of an inflatable raft apparatus can be minimized to eliminate environmental concerns associated with such adhesives.

It is an object of the present invention to provide a polygonally shaped inflatable raft apparatus having an extended outer flap segment integral therewith and extending therefrom wherein a dual inflatable invertible structure can be easily achieved with the same modular design as utilized with a single unit inflatable raft apparatus.

It is an object of the present invention to provide a polygonally shaped inflatable raft apparatus having an extended outer flap segment integral therewith and extending therefrom wherein the polygonal shaped inflatable raft basic construction can be utilized inverted to provide the extended outer flap segment to facilitate connection of the cover and/or canopy member extending over the raft.

It is an object of the present invention to provide a polygonally shaped inflatable raft apparatus having an extended outer flap segment integral therewith and extending therefrom wherein the same basic structure can be maintained to achieve the full strength and operational characteristics of prior art raft configurations while eliminating adhesively cemented seams to facilitate reliability and efficiency of the final raft design.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
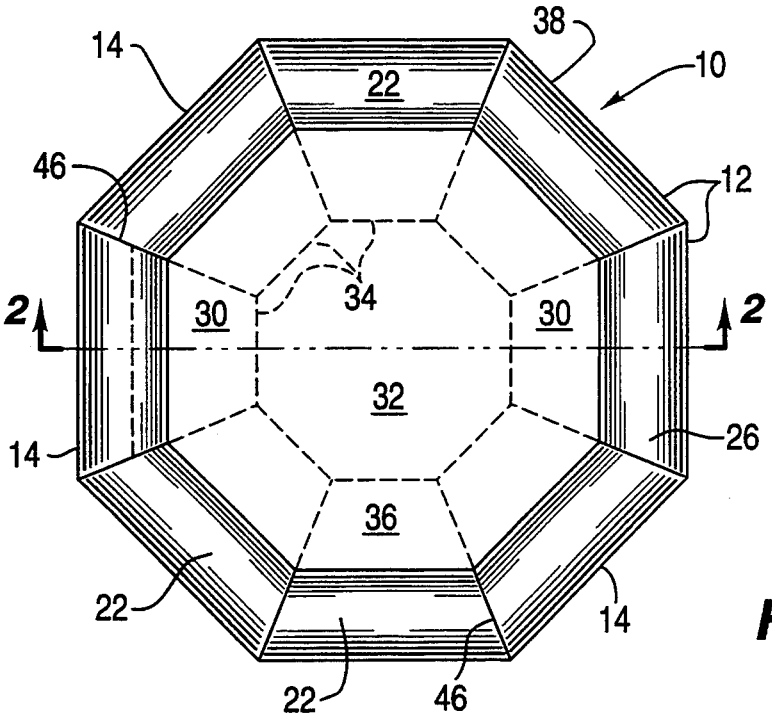
FIG. 1 is a top plan view of an embodiment of a polygonally shaped inflatable raft apparatus of the present invention.

The present invention provides a raft 10 having a flotation member 12 of a general polygonal shape. Flotation member 12 is formed of a plurality of individual panel members 14 which are inflatable. Each panel member is generally tubular in shape and is formed by interconnecting an inner flap means 16 with an outer flap means 18 thereof to form a closing seam 20 formed by overlapping the inner and outer flaps with respect to one another. The main panel wall 22 of panel member 14 extends from the inner flap 16 to the outer flap 18 and assumes a generally circular arc 24 in cross-sectional shape in order to form the tubular flotation member. The general configuration of such an inflatable raft is shown in FIG. 1.

Figure 2:
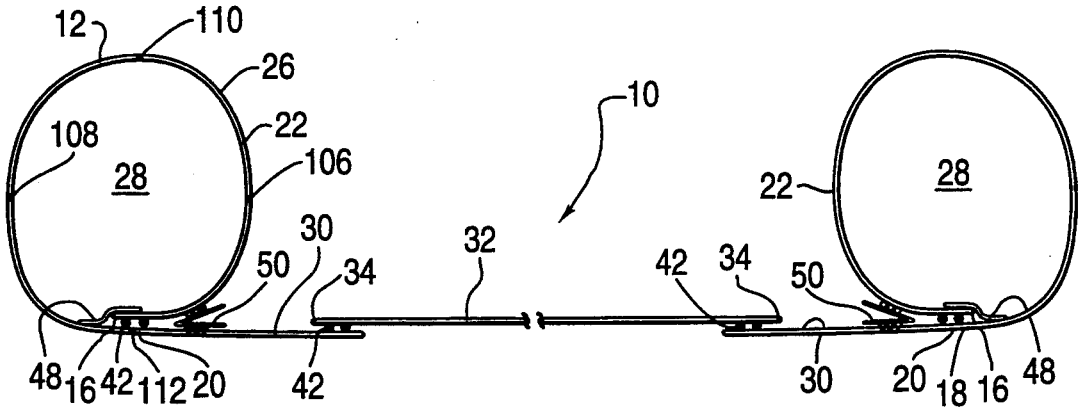
FIG. 2 is a cross-sectional view of the embodiment shown in FIG. 1 along lines 2—2.
Figure 7:
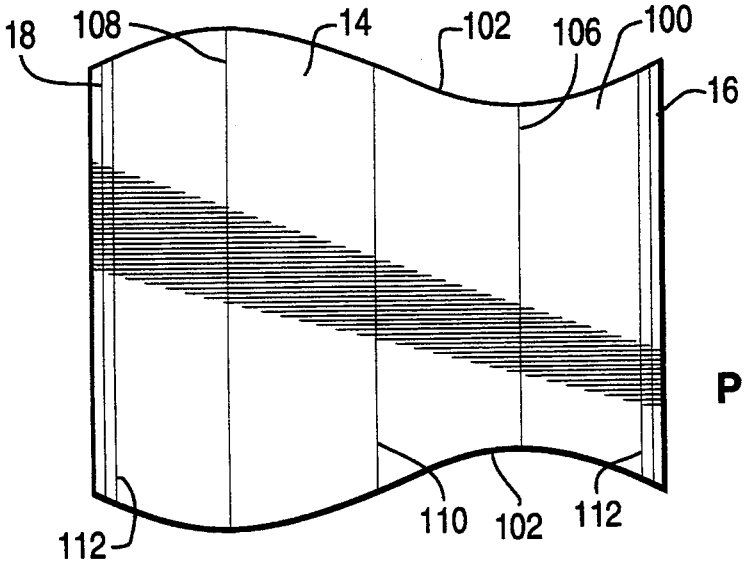
FIG. 7 PRIOR ART
FIG. 7 is a top plan view of a main panel member of the prior art shown prior to closing of the seam between the inner and outer flaps.

FIG. 7 shows the individual panel member 14 of the prior art prior to interconnecting of the inner flap 16 with respect to the outer flap 18 to form the closing seal 20. As shown in FIG. 7 when this panel is formed into the cylindrical shape the inner flap 16 will be secured to the outer flap 18. Each of these two flaps are linear and are adapted to be secured to one another to form the overlapping closing seal 20. When the closing seam 20 is closed the line 106 will form the innermost line of the tubular section as shown in FIG. 2 whereas the outermost line 108 will be the outermost point of the panel member 14 as also shown in FIG. 2. It should also be noted that the uppermost line 110 showing the blank in FIG. 7 will be in a position shown by reference numeral 110 in FIG. 3. Finally the lowermost line 112 will be positioned at the location of each of the flaps 16 and 18 and will be the lowermost point of the circular arc 24 of the panel member 14.

For theoretical constructional purposes this panel is a continuous member and can be cut along line 106, 108, 110 or 112 with the inner and outer flaps 16 and 18 attached at whichever of these points is desired to be cut. This would provide the closing seam in the configuration shown in FIG. 2 at points 106, 108, 110 or 112 as desired. In the prior art, such a choice of positioning was not deemed to be particularly significant. However, with the present invention utilizing an extended outer flap segment 30 integral with the outer flap 18 and extending away therefrom, the particular chosen position of the closing seam 20 where the inner and outer flap means 16 and 18 interconnect is particularly important since this will be the point where attachment of additional structures will be significantly facilitated.

Figure 8:
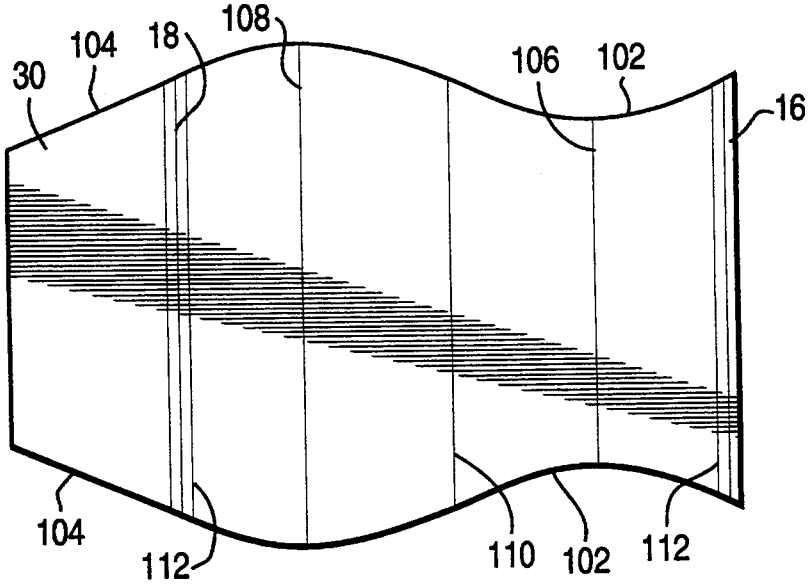
FIG. 8 is a top plan view of an embodiment of the main panel member of the present invention prior to sealing of the closing seam between the inner and outer flap members showing the extended outer flap segment configured therewith.

It should be noted in the configuration shown in FIG. 7 as well as in FIG. 8 that the lateral edges 102 of the panel blank 100 are arcuate. In the configuration of the present invention shown in FIG. 8 the outer flap means 18 is shown on the left side of the figure with the extended outer flap segment 30 extending to the left therefrom. It should be noted that the extended outer flap segment 30 defines straight lateral extended sides 104 extending therefrom which are tangential to the arcuate lateral edges 102 of the main panel member 14 at the point of interconnection thereto. It is the inclusion of this integrally formed extended outer flap segment 30 which provides the advantages of a modular construction and significantly expands the possibility of usage of heat sealing in regard to inflatable constructions.

When the panel blank 100 of the present invention shown in FIG. 8 is formed through a circular arc 24 into a tubular shape 26 as shown best in FIG. 2, a buoyancy chamber 28 will be defined therein. This buoyancy chamber will be interconnected with respect to adjacent buoyancy chamber of adjacently positioned panel members 14 such that the buoyancy chambers 28 of each adjacent panel chamber will be in fluid flow communication with respect to one another to facilitate simultaneous inflation thereof.

The present invention is particularly usable with respect to a floor means 32 which preferably is of a planar and polygonal shape such that the outer periphery 34 of the floor 32 is adapted to be secured with respect to the extended outer flap segments 30 as shown best in FIG. 2. With this configuration, a means is provided for heat sealing of the floor means 32 in place due to the fact that the point of securement with respect to the inflatable panel members 14 is now remotely positioned from the buoyancy chamber 28 thereof. Thus heat sealing rather than adhesive can be used to make this interconnection.

Figure 3:
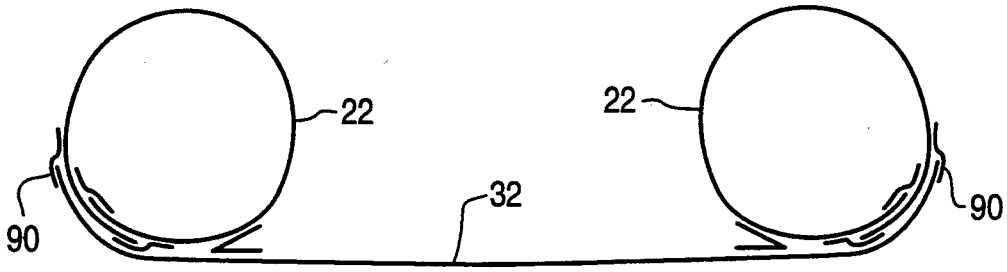
FIG. 3 PRIOR ART
FIG. 3 is a cross-sectional view of a standard inflatable raft apparatus of the prior art.

On the other hand in the prior art configuration as shown best in FIG. 3, the adhesive connection 90 is made between the floor 32 and the tubular inflatable member in view of the fact that the prior art does not teach the usage of an extended outer flap segment 30 which would be integral with the panel member 14. Since floor 32 is attached directly to the inflatable main panel wall 22 this interconnection in prior art designs had to be made by adhesive rather than heat sealing. The present invention positions this interconnection remotely from the buoyancy chamber 28 and, as such, allows for heat sealing to hold the floor 32 in proper position.

Figure 6:
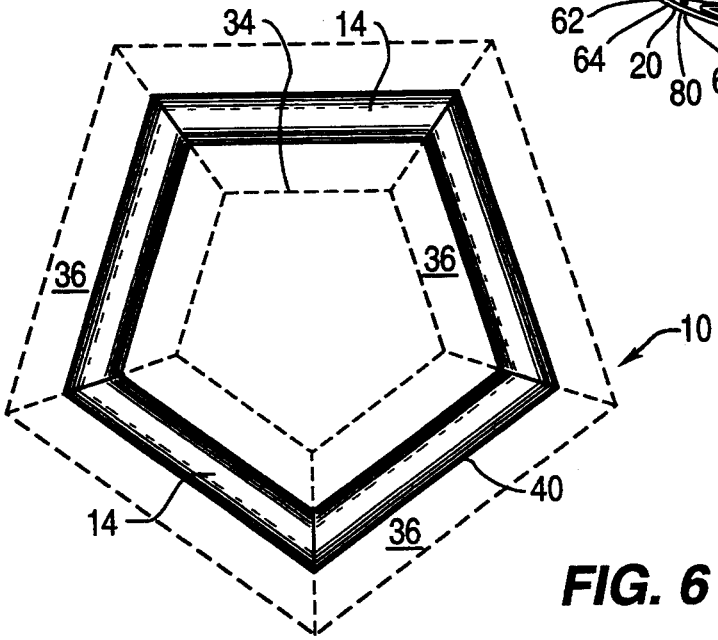
FIG. 6 is a top plan view of an embodiment of an irregularly polygonally shaped inflatable raft having five panels made in accordance with the present invention.
Figure 9:
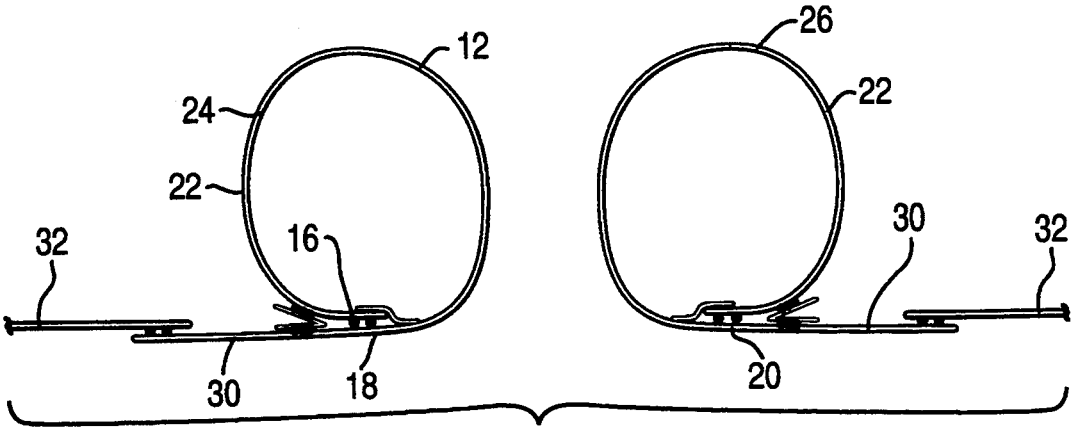
FIG. 9 is a side cross-sectional view of an embodiment of a polygonally shaped raft apparatus of the present invention showing the floor positioned outside of the inflatable member rather than internally therewithin as shown in FIG. 2.

The extended outer flap segment 30 is preferably of a trapezoidal shape. This trapezoidal shape can be best shown in FIGS. 1 and 6. The extended outer flap segment 30 can extend inwardly as shown in FIG. 1 and the interior portion of FIG. 2 but also could be configured extending outwardly as shown in FIG. 6. The side cross-sectional views of the extended outer flap segment 30 extending inwardly is shown in FIG. 2 whereas the side cross-sectional view of the extended outer flap segment 30 extending outwardly is shown in FIG. 9. As such, the floor can be positioned within the polygonally shaped flotation member 12 or can be positioned outside thereof if such a configuration is desired merely by reversing the positioning of the seams such that the outer flap 18 extends over the inner flap in the outwardly projecting direction rather than the inwardly projecting direction.

The present invention is usable with a regular polygon shape 38 or can be used with an irregular polygon shape 40. The irregular polygon shape can have different lengths in the individual polygonal segments or can have an even or odd total number of sides.

The heat seal 42 between the floor and the skirt is best shown in FIG. 2 and is remotely positioned from the inflatable flotation member 12 and the panel members 14. Heat sealing has been shown to be more reliable both as being durable and achieving full sealing. Adhesive seals such as those used in the prior art at 90 can sometimes deteriorate and can bleed dangerous chemicals into the water environment. Therefore under the consideration of a formerly reliable raft design as well as being environmental responsible, the usage of heat sealing over adhesive sealing is significantly advantageous.

It should be appreciated that the longitudinal openings 46 facilitate communication between adjacent tubular chambers. Also in the additional elements interconnected to the main flotation member 12 such as arches or other external structure can also be interconnected for fluid flow communication to facilitate simultaneous inflation thereof when the main inflation member 12 is inflated.

It should be appreciated that in prior art configurations, as shown in FIG. 3, an inner sealing tape 48 is used as well as an outer sealing tape 50. Preferably the outer sealing tape is V-shaped. It should be further appreciated that the present invention although providing an alternative means for securing of a floor 32 with respect to the panel members 14 does allow for full usage of the conventional inner and outer sealing tapes 48 and 50 as shown in the prior art. These tapes can be utilized to further secure the closing seal 20 and for strengthening and assuring full sealing thereof.

The present invention is particularly usable for forming a single raft utilizing an internal polygonally shaped floor as shown in FIGS. 1 and 2. However the present invention is also useful in utilizing the basic singular modular design shown in the FIG. 2 configuration for forming more complex structures such as the invertible raft 92 shown in FIG. 4 or the covered raft 94 as shown in FIG. 6.

Figure 4:
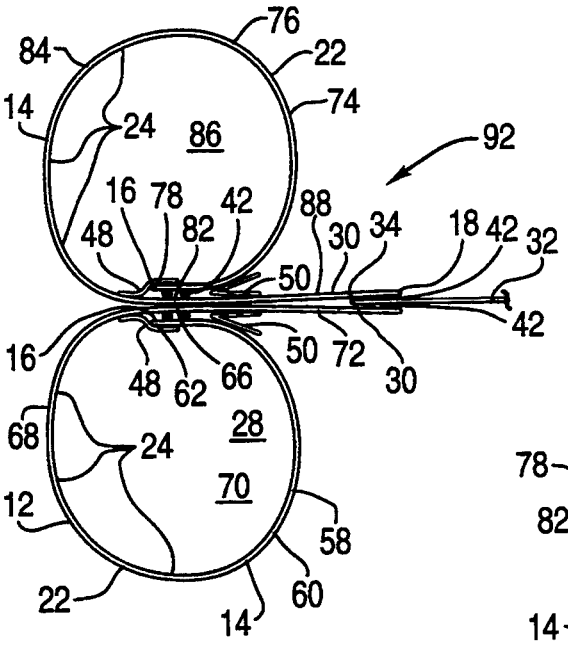
FIG. 4 is a side plan view of an embodiment of an inflatable raft in accordance with the present invention which is invertible.

The invertible raft 92 shown in FIG. 4 includes a first polygonally shaped flotation member 58 having a first panel 60 and a first inner flap 62 and a first outer flap 64 sealed with respect to one another along a first closing seam 66. A first panel wall section 68 extends between the inner and outer flaps 62 and 64 to define a first buoyancy chamber 70 therein. A first extended outer flap segment 72 extends inwardly from the first outer flap 64 to facilitate attaching of an inner floor thereto.

In a similar configuration a second polygonally shaped flotation member 74 is formed by a plurality of second panel members 76 which are end joined together and are each individually formed by securement of a second inner flap 78 with respect to a second outer flap 80 to form a second closing seam 82. The second panel wall section will extend between the individual flaps 78 and 80 to form a second buoyancy chamber 86 therein. A second extended outer flap segment 88 will extend inwardly from the second outer flap 80. With this configuration the first extended outer flap segment 72 and the second extended outer flap segment 88 will be positioned immediately adjacent to one another preferably with the floor member 32 secured thereto and positioned therebetween. With this configuration the raft design shown in FIG. 4 is fully invertible and, as such, is made extremely difficult to capsize. It is also preferable that the first panel member 60 and the second panel member 76 themselves be individually interconnected to facilitate structural integrity of the design.

Figure 5:
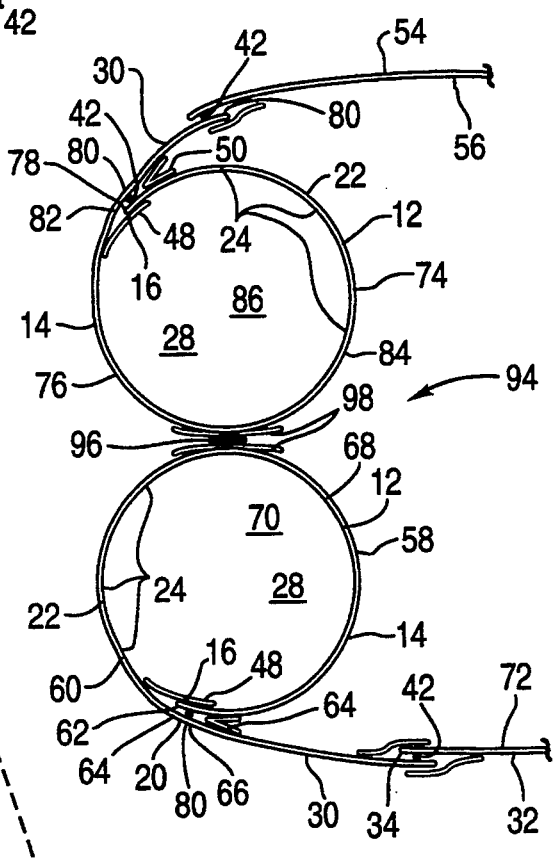
FIG. 5 is side cross-sectional view of an embodiment of the polygonally shaped inflatable apparatus of the present invention showing the inclusion of a cover or canopy means thereover.

In an alternative configuration as shown in FIG. 5 the closing seam is chosen on the opposite sides of the first and second panel members 60 and 76 respectively. With this configuration the panel members can be interconnected with respect to one another such as at interconnection point 96 and also can include reinforcing material 98 extending therebetween to strengthen this interconnection. With this configuration the first flotation member 58 shown in FIG. 5 as the lower flotation member will achieve the standard floor design shown in the configuration of FIG. 2. On the other hand, however, the second flotation member 74 shown as the upper flotation member in FIG. 5 will allow a cover member 54 or canopy 56 to be secured thereto to extend over the raft to provide additional protection to users thereof.

As such, you can see that the single basic modular configuration shown in FIG. 2 can be used to form a basic raft design as shown in FIG. 2 as well as an inflatable raft design as shown in FIG. 4 as well as a covered raft design as shown in FIG. 5. This modularity of the design is made possible by the use of the extended outer flap segment 30 which provides a point for connection to a tubular inflatable panel member 14 at a remote location thereof such that heat sealing is made possible and the attachment of different types of external construction is made possible.

I claim:

1. An inflatable raft apparatus, with a polygonally-shaped inflatable member having an extended outer flap segment integral therewith and extending therefrom, comprising:

A. a plurality of panel members being end joined with respect to one another to form a polygonal shape, each panel member including:

(1) a main panel wall formed in a generally tubular shape;

(2) an inner flap means extending along said main panel wall;

(3) a outer flap means defined on said main panel wall at a position spatially disposed from said inner flap means, said outer flap means and said inner flap means being secured with respect to one another to define a closing seam and to form a buoyancy chamber within said main panel wall;

(4) an extended outer flap segment extending away from said outer flap means and being integral therewith to facilitate attachment thereto; and B. a floor means being generally planar and attached to each of said extended outer flap segments of said panel members at a position spatially disposed from said main panel wall to form a floor area with said extended outer flap segments.

2. An inflatable raft apparatus, with a polygonally-shaped inflatable member having an extended outer flap segment integral therewith and extending therefrom, as defined in claim 1 wherein said extended outer flap sections extend inwardly from said main panel walls and wherein said floor means is attached along the outer periphery thereof to said extended outer flap sections to define a floor area therewithin.

3. An inflatable raft apparatus, with a polygonally-shaped inflatable member having an extended outer flap segment integral therewith and extending therefrom, as defined in claim 1 wherein said extended outer flap sections extend outwardly from said main panel walls and wherein said floor means is attached to said extended outer flap sections to define a floor area therearound.

4. An inflatable raft apparatus, with a polygonally-shaped inflatable member having an extended outer flap segment integral therewith and extending therefrom, as defined in claim 1 wherein each of said extended outer flap segments is trapezoidal in shape.

5. An inflatable raft apparatus, with a polygonally-shaped inflatable member having an extended outer flap segment integral therewith and extending therefrom, as defined in claim 1 wherein said panel members are equal in length to define a regular polygon shaped inflatable raft apparatus.

6. An inflatable raft apparatus, with a polygonally-shaped inflatable member having an extended outer flap segment integral therewith and extending therefrom, as defined in claim 1 wherein said panel member are of different longitudinal lengths from one another to form an irregular polygon shaped inflatable raft apparatus.

7. An inflatable raft apparatus, with a polygonally-shaped inflatable member having an extended outer flap segment integral therewith and extending therefrom, as defined in claim 1 wherein said inner flap means is heat sealed to said outer flap means to facilitate securement of a closing seam therebetween.

8. An inflatable raft apparatus, with a polygonally-shaped inflatable member having an extended outer flap segment integral therewith and extending therefrom, as defined in claim 1 wherein said inflatable panel section further defines a first longitudinal opening and a second longitudinal opening therein for end joining to adjacent similarly configured panel members to join together the polygonally shaped inflatable raft apparatus.

9. An inflatable raft apparatus, with a polygonally-shaped inflatable member having an extended outer flap segment integral therewith and extending therefrom, as defined in claim 8 wherein said first longitudinal opening and said second longitudinal opening are positioned to extend in opposite directions with respect to each other to facilitate end joining thereof.

10. An inflatable raft apparatus, with a polygonally-shaped inflatable member having an extended outer flap segment integral therewith and extending therefrom, as defined in claim 9 wherein said first longitudinal opening and said second longitudinal opening are in fluid flow communication with respect to said buoyancy chamber.

11. An inflatable raft apparatus, with a polygonally-shaped inflatable member having an extended outer flap segment integral therewith and extending therefrom, as defined in claim 1 further comprising an inner sealing tape means positioned within said buoyancy chamber extending over said closing seam formed by attachment of said inner flap means to said outer flap means to facilitate sealing and attachment therebetween.

12. An inflatable raft apparatus, with a polygonally-shaped inflatable member having an extended outer flap segment integral therewith and extending therefrom, as defined in claim 1 further comprising outer sealing tape means positioned outside of said buoyancy chamber extending over said closing seam formed by attachment of said inner flap means to said outer flap means, said outer sealing tape means being V-shaped.

13. An inflatable raft apparatus, with a polygonally-shaped inflatable member having an extended outer flap segment integral therewith and extending therefrom, as defined in claim 1 wherein said main panel wall defines arcuate outer edges extending from said inner flap means to said outer flap means to facilitate formation of a tubular shape thereof and to facilitate end joining of said panel member with respect to one another.

14. An inflatable raft apparatus, with a polygonally-shaped inflatable member having an extended outer flap segment integral therewith and extending therefrom, as defined in claim 13 wherein said extended outer flap segment is trapezoidal in shape to define straight lateral extended sides extending outwardly from said arcuate outer edges of said main panel wall.

15. An inflatable raft apparatus, with a polygonally-shaped inflatable member having an extended outer flap segment integral therewith and extending therefrom, comprising:

A. a plurality of panel members being end joined with respect to one another to form a polygonal shape, each panel member including:
   (1) a main panel wall formed in a generally tubular shape, said main panel wall defining a first longitudinal opening and a second longitudinal opening therein to facilitate end joining to adjacent similarly configured main panel walls, said main panel wall further defining arcuate outer edges to facilitate formation of a tubular shape thereof and to facilitate end joining of said panel member with respect to one another in a polygonal shape;
   (2) an inner flap means extending along said main panel wall;
   (3) a outer flap means defined on said main panel wall at a position spatially disposed from said inner flap means, said arcuate outer edges of said main panel wall extending from said inner flap means to said outer flap means, said outer flap means and said inner flap means being secured with respect to one another by heat sealing to define a closing seam and to form a buoyancy chamber within said main panel wall, said buoyancy chamber being in fluid flow communication with respect to said first longitudinal opening and said second longitudinal opening;
   (4) an extended outer flap segment being trapezoidally shaped and extending inwardly from said outer flap means and being integral therewith to facilitate attachment thereto, said extended outer flap segment including linear lateral extended sides extending straight outwardly from said arcuate outer edges of said main panel wall to facilitate securement therebetween;

B. a floor means positioned within said panel members formed into a polygonal shape and being generally planar and attached at the outer periphery thereof to each of said extended outer flap segments of said panel members at a location spatially disposed from said main panel wall to form a floor area with said extend outer flap sections within the inflatable raft apparatus;

C. an inner sealing tape means positioned within said buoyancy chamber extending over said closing seam formed by securement of said inner flap means to said outer flap means to facilitate sealing and attachment therebetween; and D. a V-shaped outer sealing tape means positioned outside of said buoyancy chamber extending over said closing seam formed by securement of said inner flap means to said outer flap means to facilitate sealing and attachment therebetween.

16. An invertible inflatable raft apparatus, with two polygonally-shaped inflatable members having extended outer flap segments integral therewith and extending therefrom, comprising:

A. a plurality of first panel members being end joined with respect to one another to form a first polygonal shape, each first panel member including:
   (1) a first main panel wall formed in a generally tubular shape, said first main panel wall defining a two first longitudinal openings therein to facilitate end joining to adjacent similarly configured first main panel walls, said first main panel wall further defining first arcuate outer edges to facilitate formation of a tubular shape thereof and to facilitate end joining of said first panel members with respect to one another in a polygonal shape;

(2) a first inner flap means extending along said first main panel wall;

(3) a first outer flap means defined on said first main panel wall at a position spatially disposed from said first inner flap means, said first arcuate outer edges of said first main panel wall extending from said first inner flap means to said first outer flap means, said first outer flap means and said first inner flap means being secured with respect to one another by heat sealing to define a first closing seam and to form a first buoyancy chamber within said first main panel wall, said first buoyancy chamber being in fluid flow communication with respect to said first longitudinal openings;

(4) a first extended outer flap segment being trapezoidally shaped and extending inwardly from said first outer flap means and being integral therewith to facilitate attachment thereto, said first extended outer flap segment including first linear lateral extended sides extending straight outwardly from said first arcuate outer edges of said first main panel wall to facilitate securement therebetween;

B. a first inner sealing tape means positioned within said first buoyancy chamber extending over said first closing seam formed by securement of said first inner flap means to said first outer flap means to facilitate sealing and attachment therebetween;

C. a first V-shaped outer sealing tape means positioned outside of said first buoyancy chamber extending over said first closing seam formed by securement of said first inner flap means to said first outer flap means to facilitate sealing and attachment therebetween;

D. a plurality of second panel members being end joined with respect to one another to form a second polygonal shape, each second panel member including:

(1) a second main panel wall formed in a generally tubular shape, said second main panel wall defining a two second longitudinal openings therein to facilitate end joining to adjacent similarly configured second main panel walls, said second main panel wall further defining second arcuate outer edges to facilitate formation of a tubular shape thereof and to facilitate end joining of said second panel members with respect to one another in a polygonal shape, said second main panel wall sections being secured to said first main panel wall sections therealong to facilitate formation of an invertible inflatable raft apparatus;

(2) a second inner flap means extending along said second main panel wall;

(3) a second outer flap means defined on said second main panel wall at a position spatially disposed from said second inner flap means, said second arcuate outer edges of said second main panel wall extending from said second inner flap means to said second outer flap means, said second outer flap means and said second inner flap means being secured with respect to one another by heat sealing to define a second closing seam and to form a second buoyancy chamber within said second main panel wall, said second buoyancy chamber being in fluid flow communication with respect to said second longitudinal openings;

(4) a second extended outer flap segment being trapezoidally shaped and extending inwardly from said second outer flap means and being integral therewith to facilitate attachment thereto, said second extended outer flap segment including second linear lateral extended sides extending straight outwardly from said second arcuate outer edges of said second main panel wall to facilitate securement therebetween, said second extended outer flap segments being positioned adjacent to said first extended outer flap segments;

E. a second inner sealing tape means positioned within said second buoyancy chamber extending over said second closing seam formed by securement of said second inner flap means to said second outer flap means to facilitate sealing and attachment therebetween;

F. a second V-shaped outer sealing tape means positioned outside of said second buoyancy chamber extending over said second closing seam formed by securement of said second inner flap means to said second outer flap means to facilitate sealing and attachment therebetween; and G. a floor means positioned within said first panel members and said second panel members and being formed into a polygonal shape and being generally planar and attached at the outer periphery thereof to each of said first extended outer flap segments of said first panel members and to each of said second extended outer flap segments of said second panel members at a location spatially disposed from said first main panel walls and said second main panel walls, respectively, to form a floor area with said first extended outer flap sections and said second extended outer flap sections within the inflatable raft apparatus.

17. An invertible inflatable raft apparatus, with two polygonally-shaped inflatable members having extended outer flap segments integral therewith as defined in claim 16 wherein said floor means is positioned between said first extended outer flap sections and said second extended outer flap sections to facilitate interconnection therebetween and to form an invertible floor configuration.

18. A coverable inflatable raft apparatus, with two polygonally-shaped inflatable members having extended outer flap segments integral therewith and extending therefrom, comprising:

A. a plurality of first panel members being end joined with respect to one another to form a first polygonal shape, each first panel member including:

(1) a first main panel wall formed in a generally tubular shape, said first main panel wall defining a two first longitudinal openings therein to facilitate end joining to adjacent similarly configured first main panel walls, said first main panel wall further defining first arcuate outer edges to facilitate formation of a tubular shape thereof and to facilitate end joining of said first panel members with respect to one another in a polygonal shape;

(2) a first inner flap means extending along said first main panel wall;

(3) a first outer flap means defined on said first main panel wall at a position spatially disposed from said first inner flap means, said first arcuate outer edges of said first main panel wall extending from said first inner flap means to said first outer flap means, said first outer flap means and said first inner flap means being secured with respect to one another by heat sealing to define a first closing seam and to form a first buoyancy chamber within said first main panel wall, said first buoyancy chamber being in fluid flow communication with respect to said first longitudinal openings;

(4) a first extended outer flap segment being trapezoidally shaped and extending inwardly from said first outer flap means and being integral therewith to facilitate attachment thereto, said first extended outer flap segment including first linear lateral extended sides extending straight outwardly from said first arcuate outer edges of said first main panel wall to facilitate securement therebetween;

B. a first inner sealing tape means positioned within said first buoyancy chamber extending over said first closing seam formed by securement of said first inner flap means to said first outer flap means to facilitate sealing and attachment therebetween;

C. a first V-shaped outer sealing tape means positioned outside of said first buoyancy chamber extending over said first closing seam formed by securement of said first inner flap means to said first outer flap means to facilitate sealing and attachment therebetween;

D. a plurality of second panel members being end joined with respect to one another to form a second polygonal shape, each second panel member including:

(1) a second main panel wall formed in a generally tubular shape, said second main panel wall defining a two second longitudinal openings therein to facilitate end joining to adjacent similarly configured second main panel walls, said second main panel wall further defining second arcuate outer edges to facilitate formation of a tubular shape thereof and to facilitate end joining of said second panel members with respect to one another in a polygonal shape, said second main panel wall sections being secured to said first main panel wall sections to facilitate buoyancy of the inflatable raft apparatus;

(2) a second inner flap means extending along said second main panel wall;

(3) a second outer flap means defined on said second main panel wall at a position spatially disposed from said second inner flap means, said second arcuate outer edges of said second main panel wall extending from said second inner flap means to said second outer flap means, said second outer flap means and said second inner flap means being secured with respect to one another by heat sealing to define a second closing seam and to form a second buoyancy chamber within said second main panel wall, said second buoyancy chamber being in fluid flow communication with respect to said second longitudinal openings;

(4) a second extended outer flap segment being trapezoidally shaped and extending inwardly from said second outer flap means and being integral therewith to facilitate attachment thereto, said second extended outer flap segment including second linear lateral extended sides extending straight outwardly from said second arcuate outer edges of said second main panel wall to facilitate securement therebetween;

E. a second inner sealing tape means positioned within said second buoyancy chamber extending over said second closing seam formed by securement of said second inner flap means to said second outer flap means to facilitate sealing and attachment therebetween;

F. a second V-shaped outer sealing tape means positioned outside of said second buoyancy chamber extending over said second closing seam formed by securement of said second inner flap means to said second outer flap means to facilitate sealing and attachment therebetween;

G. a floor means positioned within said first panel members and being of a polygonal shape and generally planar and attached at the outer periphery thereof to said first extended outer flap segments of said first panel members at a location spatially disposed from said first main panel walls to form a floor area with said first extended outer flap sections and within the inflatable raft apparatus; and H. a cover means attached to each of said second extended outer flap segments of the plurality of said second main panel members and adapted to extend inwardly therefrom over said floor means to provide covering thereover.

19. A coverable inflatable raft apparatus, with two polygonally-shaped inflatable members having extended outer flap segments integral therewith and extending therefrom as defined in claim 18 wherein said cover means includes a canopy member.

20. A coverable inflatable raft apparatus, with two polygonally-shaped inflatable members having extended outer flap segments integral therewith and extending therefrom as defined in claim 18 wherein said cover means extends upwardly and inwardly from said second main panel members.

* * * * *